US006510623B2

(12) United States Patent
Pajula

(10) Patent No.: US 6,510,623 B2
(45) Date of Patent: Jan. 28, 2003

(54) DRYER GROUP IN A DRYER SECTION OF A PAPER OR BOARD MACHINE AND A DRYER SECTION OF A PAPER OR BOARD MACHINE

(75) Inventor: Juhani Pajula, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 63 days.

(21) Appl. No.: 09/867,104

(22) Filed: May 29, 2001

(65) Prior Publication Data

US 2002/0002779 A1 Jan. 10, 2002

(30) Foreign Application Priority Data

May 31, 2000 (FI) ..... 20001307

(51) Int. Cl.[7] ..... F26B 11/02; D21F 1/36

(52) U.S. Cl. ..... 34/116; 34/117; 34/120; 34/126; 162/193; 162/207; 162/358.5; 162/359.1

(58) Field of Search ..... 34/114, 115, 116, 34/117, 120, 122, 123, 126; 162/193, 204, 205, 206, 207, 265, 358.1, 358.5, 359.1

(56) References Cited

U.S. PATENT DOCUMENTS 4,361,466 A 11/1982 Wong et al.
5,588,223 A 12/1996 Marshall
5,865,955 A 2/1999 Ilvespää et al.
6,368,459 B1 * 4/2002 Kinnunen ..... 162/207
6,372,090 B1 * 4/2002 Laapotti ..... 162/206
6,442,865 B1 * 9/2002 Wolf et al. ..... 34/114

FOREIGN PATENT DOCUMENTS

FI 102623 1/1999

OTHER PUBLICATIONS

"Drying Concepts for High Demands", Markus Oeschle, *Paper and Timber* vol. 81 No. 8/1999 pp. 544–547.

A copy and a translation of the Official Action in the Finnish Priority Application No. 20001307.

* cited by examiner

*Primary Examiner*—Pamela Wilson
(74) *Attorney, Agent, or Firm*—Lathrop & Clark LLP

(57) ABSTRACT

A cantilevered frame in a paper machine dryer group of a dryer section supports a drying wire loop to run by at least one impingement drying unit positioned outside the loop. The frame structure (60) supports devices and rolls situated inside the wire loop (13) of the dryer group (R) which guide and support the run of the wire (13) and the web (W). A dryer section may have multiple such dryer groups which overlap one another with closed draws therebetween.

19 Claims, 4 Drawing Sheets

DRYER GROUP IN A DRYER SECTION OF A PAPER OR BOARD MACHINE AND A DRYER SECTION OF A PAPER OR BOARD MACHINE

CROSS REFERENCES TO RELATED APPLICATIONS

This application claims priority on Finnish Application No. 20001307, filed May 31, 2000, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to dryer groups in a dryer section of a paper or board machine, and to dryer sections of paper or board machines.

As known from the prior art, in multi-cylinder dryers of a paper machine, twin-wire draw and/or single-wire draw in/are employed, In twin-wire draw, the groups of drying cylinders comprise two wires which press the web, one from above and the other one from below, against heated cylinder surfaces. Between the rows of drying cylinders, which are usually horizontal rows, the web has free and unsupported draws, which are susceptible to fluttering, which may cause web breaks, in particular as the web is still relatively moist and, therefore, has a low strength. Therefore, ever increasing use has been made of said single-wire draw in which each group of drying cylinders comprises—only one drying wire on whose support the web runs through the entire group so that, on the drying cylinders, the drying wire presses the web against the heated cylinder surfaces and, on the reversing cylinders or rolls situated between the drying cylinders, the web remains at the side of the outside curve. Thus, in single-wire draw, the drying cylinders are arranged outside the wire loop, and the reversing cylinders or rolls are arranged inside the loop. One problem with these prior art arrangements is constituted by the cylinders and rolls which are situated outside the wire loop and which get soiled, wherefore it has been necessary to provide them with doctors to keep the surfaces clean.

With increasing speeds of paper machines, the runnability of a paper machine is, of course, also affected by the dryer section, whose length with the prior art multi-cylinder dryers would, at high speeds, also become very long. If it is imagined that a present-day multi-cylinder dryer were used at a web speed of 40 m/s, it would include about 70 drying cylinders, and its length in the machine direction would be about 180 meters. In such a case, the dryer would comprise about 15 separate wire groups and a corresponding number of draws over the group gaps. It is to be assumed that, in a speed range of from 30 to 40 m/s, the runnability of the normal prior art multi-cylinder dryers would not be good because of the open draws, in which connection there may occur web breaks that reduce the efficiency of the paper machine. In a speed range of from 30 to 40 m/s and at higher speeds, the prior art multi-cylinder dryers, then, would also become uneconomical because the investment costs of an excessively long paper machine hall would be high. The dryer sections composed of multi-cylinder dryers are often also very high.

Moreover, in dryer groups of known applications, wires seamed on the machine have to be used because of the closed frame structure. The seam of a wire seamed on the machine may cause a discontinuity in the drying of the web in connection with the drying process. In addition, the seam of the wire seamed on the machine may limit the applied tension of the wire.

Further problems manifested with increased emphasis at high speeds of paper machines, for which problems, at least for all of them, satisfactory solutions have not been found as yet, include the problems of quality related to the requirements of uniformity of the profiles of properties of the paper web both in the machine direction and in the cross direction. Uniformity of the web produced also affects the runnability of the entire paper machine, and it is also an important quality factor of finished paper. Application of high speeds, in particular in wide machines, thus provides ever more difficult problems to be solved, of which problems, the most important ones are runnability and adequate dewatering capacity of the machine at a high speed.

One problem in dryer sections of a paper machine, when conventional dryer sections composed of multi-cylinder dryers are used, is the noise they cause. In addition, when cylinder drying is employed, it is necessary to use steam, which means that the drying cylinders have to be dimensioned to comply with pressure vessel regulations and, furthermore, the hood arranged around the dryer section has to be made to be thermally insulated.

It is known from experience that, if paper is dried one-sidedly, the result is a tendency of curling of the sheet. When paper is dried by means of normal singlewire draw groups from the side of its bottom surface and, if such asymmetric drying is extended substantially over the entire length of the dryer section, the drying occurs such that the side of the bottom surface of the web dries first and, when the drying makes progress, the drying effect is also extended to the side of the top surface of the web. Under these circumstances, the dried paper usually curls and becomes concave, seen from above.

With respect to the prior art related to the invention, reference is made to FI Patent 102623 which discloses a method in a paper machine or equivalent, wherein water is removed from a web or equivalent in a press and, after pressing, the web is dried in at least one dryer group based on impingement drying or equivalent. In this prior art arrangement, the web is guided along a substantially linear path or by using a large radius of curvature and, in the drying stage, after the impingement drying, the web or equivalent is dried in at least one dryer group in which a normal single-wire draw is applied, and the web is passed from the pressing stage to the drying stage as a closed draw and such that the web is constantly supported against at least one support surface. The above-mentioned patent discloses different types of applications for arranging impingement drying units in a dryer section, and with respect to arrangements of this type, reference is also made to the magazine article *Markus Oeschle: "Drying concepts for high demands"*, Paper ja Puu, Vol. 81, *No.* 8/1999.

SUMMARY OF THE INVENTION

An object of the invention is to provide a dryer section and a dryer group in which the above-noted drawbacks and problems known in the prior art have been eliminated or at least minimized.

In addition, one object of the invention is to provide a dryer section concept that makes it possible to apply shorter and lower dryer sections than heretofore as compared with prior art dryer sections.

A further object of the present invention is to provide a dryer section which allows good runnability and a mainly closed draw of the web to be provided.

A further object of the invention is to enable a dryer section concept to be applied in which good quality of paper and sufficiently undisturbed runnability are achieved.

A further object of the invention is to provide a drying method and a dryer section applying the method in which the web reliably adheres to a drying wire over the entire length of the dryer section such that its cross direction shrinkage can be mainly inhibited, thereby avoiding cross direction inhomogeneities of the web caused by non-uniform cross direction shrinkage profile.

A still further object of the invention is to provide a dryer group and a dryer section having a new type of frame structure enabling compact dryer groups and a compact dryer section to be formed.

A still further object of the invention is to create a dryer group in which a factory-preseamed drying wire loop is threaded in place in the cross direction of the machine.

Thus, an object of the present invention is to offer new solutions to the problems discussed above so that said drawbacks as well as those coming out later in the prior art are chiefly avoided.

In accordance with the invention, the dryer groups of a dryer section are formed of at least one impingement drying unit, by means of which the web is dried directly, i.e. drying blowings are directed directly, not through a wire, at the web and the wire supporting and guiding the run of the web is on the opposite side of the web to the impingement drying unit/units. A frame structure is placed inside the wire loop, and the components and devices arranged inside the wire loop and leading and guiding the run of the wire and the web, advantageously all the components and devices in question, are supported on said frame structure. The frame structure supporting the group is positioned advantageously such that the main direction of the group is inclined with respect to the horizontal direction. Because of the new type of group structure, the dryer section becomes low and short, and the groups are located with respect to one another preferably in an overlapping fashion, whereby the length of the dryer section is further shortened. In accordance with an advantageous application of the invention, the dryer groups in the dryer section are so located that one side of the web is dried first and then the other side, in which connection there arises no one-sided curling tendency in the web.

When a dryer section is formed in accordance with the invention, between the cylinder and the wire there remains no opening gap which would limit speed, but, instead, the dryer groups are so placed that the draw over the group gap is closed.

In the invention, the web which is dried is advantageously supported by means of under-pressure devices, for example, by means of blow or suction boxes and/or suction rolls, in order to further improve runnability, which devices simultaneously assist in preventing web shrinkage.

When impingement drying is applied, no steam is required in the dryer section, in which connection the hood can be built to be simpler because it need not be thermally insulated. Impingement drying is also less noisy than cylinder drying, which means that the sound insulation of the hood is also easier to provide.

Since impingement drying is more effective than multi-cylinder drying, the dryer section becomes shorter when compared with a dryer section formed of multi-cylinder dryers. Furthermore, impingement drying is quicker than multi-cylinder drying in connection with starting of a paper machine.

In the arrangement in accordance with the invention, when compared with conventional multi-cylinder drying, there is less revolving mass, in which connection the problems arising from vibration are minimized. In addition, the design of the foundation is therefore less expensive and the foundation can be built to be lighter-weight.

A guide and tension device assembly is advantageously used in connection with the dryer groups of the dryer section in accordance with the invention, which device is used at the same time for both guiding the run of the wire and for tensioning it to desired tightness.

The dryer groups according to the invention are compact because of their new type of frame structure, in which connection shorter, factory-seamed wires can be used because the frame of the dryer group can be cantilevered for threading the wire loop in place. In addition, the factory-seamed drying wire loop can be considered in practice to be seamless because the fabric structure of the wire loop is uniform and does not cause any discontinuity in the drying of the web. Moreover, a higher wire tension can be used for factory-seamed wires than for wires which are seamed in the machine.

In one advantageous application of the invention, rolls or cylinders are not needed at all outside the wire loop, thereby obviating the need for doctors.

In accordance with the invention, the entire dryer section or at least one dryer group of a part of the dryer section can be formed of dryer groups according to the invention and, when desired, dryer groups according to the invention can thus be used with conventional multi-cylinder dryer groups or other types of dryer groups in the dryer section.

Further objects, features and advantages of the invention will be apparent from the following detailed description when taken in conjunction with the accompanying drawings.

DESCRIPTION OF THE PREFERRED EMBODIMENTS

In the following, a dryer group according to one embodiment example of the invention is first described with reference to FIG. 1. Dryer groups R shown in FIG. 1 have been used in FIGS. 2–4, which groups can be in the position shown in FIG. 1 or, as shown in the figures, in an inverted position. In the normal position, as shown in FIG. 1, impingement drying units 30 of the dryer group R are situated beneath the group and, in the inverted position, as, for example, the second groups in FIGS. 2, 3, 4 and 5, the impingement drying units have been placed above the group.

Figure 1:
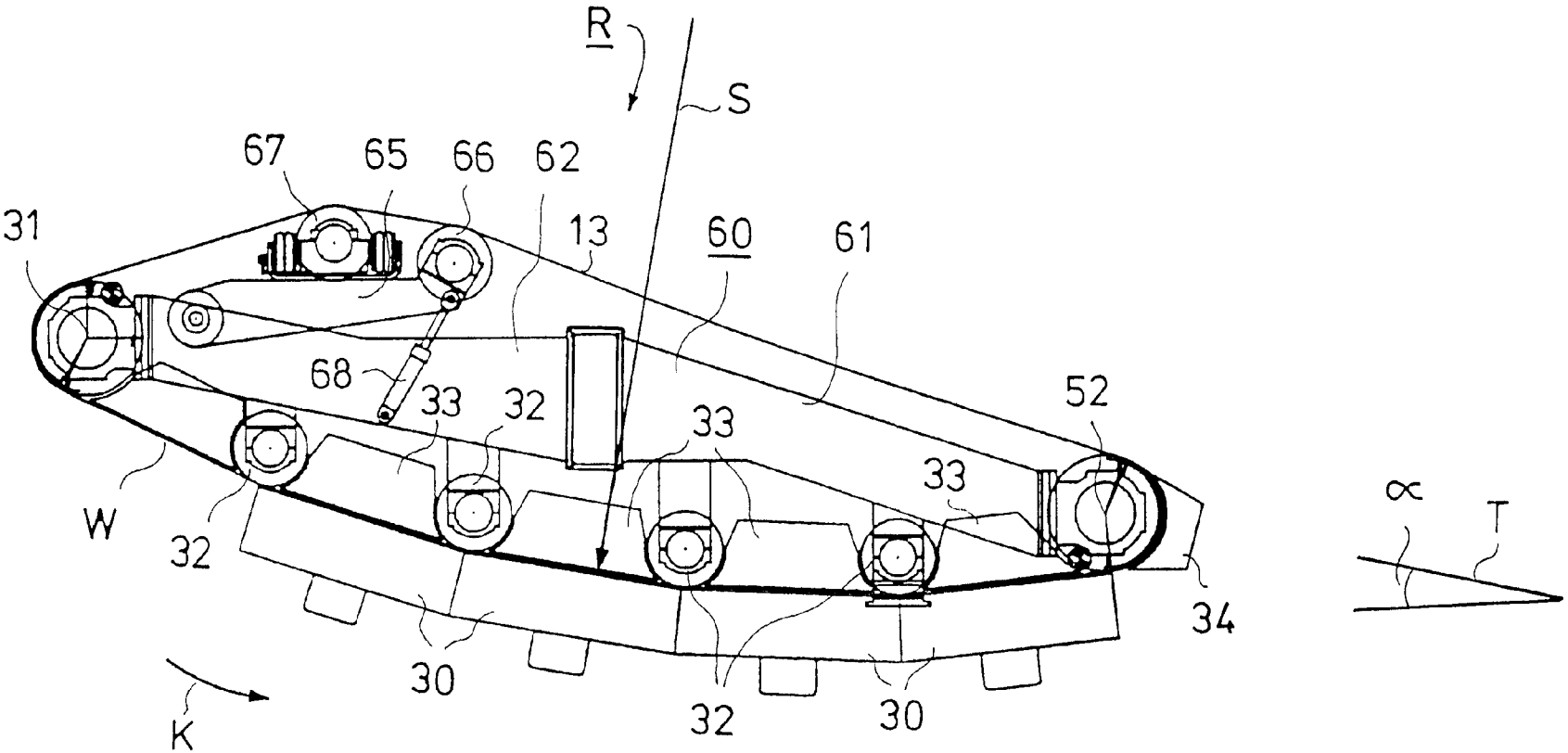
FIG. 1 schematically shows one application for a dryer group according to the invention.

As shown in FIG. 1, the dryer group R comprises impingement drying units 30, which have been placed outside the loop formed by a wire 13, on the outer surface of which wire a web W runs on support of the wire 13 between the impingement drying units 30 and under-pressure devices 33, for example, suction and/or blow boxes. Inside the wire loop 13, support rolls 32 have been attached to frame structures 60 in order to support the run of the wire 13 and, at the same time, also the run of the web W, and under-pressure devices enhancing runnability, for example, the suction and/or blow boxes 33, have been placed in the spaces between the support rolls 32. When needed, the support rolls 32 can be suction rolls to further enhance runnability. The wire loop 13 has been placed outside the frame structure 60, which frame structure 60 supports all the rolls 31,32,52 and devices 33,65,66,67,68 of the dryer group R located inside the wire loop 13, by means of which rolls and devices the run of the web W and the wire 13 is guided and/or supported.

The frame structure 60 is formed of two beam-shaped arms 61, 62 substantially extending in opposite directions, rolls 31, 52 being placed at the end of each of said arms in order to secure the run of the wire 13 and the web W. The roll 31 is a transfer roll 31, for example, a transfer suction roll provided with one or more suction zones. The roll 52 is a turning roll 52, for example, a suction roll and advantageously a roll of the type marketed by Metso Paper, Inc. under the trademark VacRoll™ or, for example, a suction roll provided with at least one suction zone. The principal running direction of the web W has been denoted by the reference arrow K and, for example, a profile control means, an impingement drying unit or equivalent 34 has been arranged on the trailing side of the group in connection with the roll 52. The wire 13 is guided and tensioned by means of a combined guide and tension device 65, which comprises a guide roll 67, a tension roll 66 and an actuator 68, for example, a compression cylinder connected to the device assembly 65, and in which device assembly 65 the position of the tension roll 66 is adjusted by the actuator 68 such that the tension of the wire is suitable. The shape of the wire loop 13 is substantially oval and, on the drying side, the web W runs on its long curved side and the curve radius of curvature has been denoted by the arrow s. The radius of curvature s=5–50 m, preferably s=10–30 m. The main direction T of the group R with respect to the horizontal direction is advantageously inclined at an angle $\alpha$ and $\alpha$=0–60, preferably $\alpha$=5–30°.

In this description, by the main direction T of the group R is meant the direction T of the plane passing through the central axis of the rolls 31, 52 placed at the ends of the support arms 62, 61 of the frame structure 60 substantially extending in opposite directions. The angle $\alpha$ may be formed either upwards or downwards from the horizontal direction (see, for example, the second last dryer group R in FIG. 5).

In addition to the application shown in FIG. 1, the invention also encompasses dryer groups R in which the number of the impingement drying units 30 differs from that shown in FIG. 1. The dryer group R according to the invention includes at least one impingement drying unit 30, preferably 2–8. In the application shown in FIG. 1, the impingement drying units are arranged on the run underneath the wire loop 13 and, as shown in FIGS. 2–5, in the inverted position the impingement drying units 30 are arranged on the run above the wire loop 13. Thus, the drying blowings of the impingement drying units 30 are directed directly, i.e. not through the wire 13, at the surface of the web W. The impingement drying units 30 have been supported on frame structures of the machine (not shown in the figures) other than the frame structure 60 placed inside the wire loop 13 of the dryer group R.

The following FIGS. 2–6 show some applications of the invention for dryer sections or for portions of them in which dryer groups R according to the invention are used. For the sake of clarity, only some of the components have been provided with reference numerals in the figures because the groups R shown in the figures correspond in essence to the group shown in FIG. 1 or to an equivalent inverted group, unless otherwise stated. Parts or sets of parts corresponding to one another have been denoted with the same reference numerals.

Figure 2:
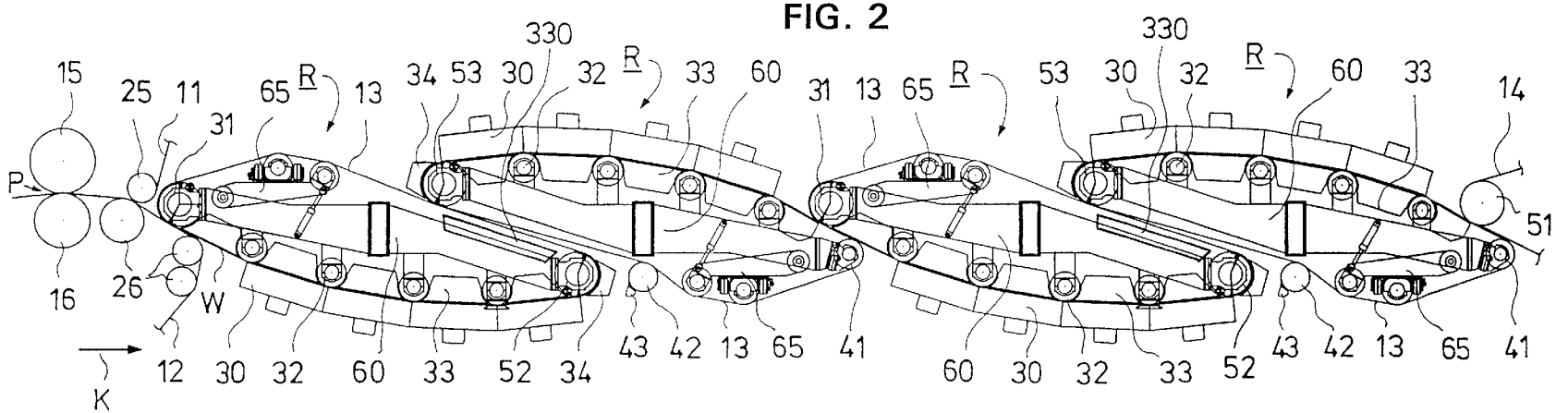
FIG. 2 schematically shows one application of the invention for a part of a dryer section formed of dryer groups according to the invention, the second and the fourth dryer group of them using an outside guide roll.

In the embodiment example shown in FIG. 2, the web W is passed to the last press nip point P of a press section on support of a press felt 11. Guided by the press felt 11, the paper web W is passed into the press nip P formed by a press roll 15 and its counter roll 16, in which nip water is removed from the web W. The upper press felt 11 runs on support of guide rolls 25. Beneath this runs a transfer belt or a press felt 12 guided by guide rolls 26, which transfer belt or press felt runs between the press roll 15 and the counter roll 16. The web W is passed from the press 15, 16 as a closed draw to the first group R of a dryer section, which group is a dryer group R according to the invention.

On support of the lower transfer belt or press felt 12 of the press nip P, the web W is passed over a transfer roll 31 onto a drying wire 13 of the group R. The dryer group R comprises blow units 30 and support rolls 32 associated with them as well as under-pressure devices 33 placed between them. The drying wire 13 runs guided and supported by the transfer roll 31, a turning roll 52, the support rolls 32 and a guide-tension device 65. The web W is passed after drying accomplished by means of the impingement drying units 30 over the turning roll 52 and, for example, by a profiling device 34 on support of the wire 13 to the next group R of the dryer section. On the turning roll 52, the running direction of the drying wire 13 and the web W carried on it is turned substantially backwards, until it is turned on the first transfer roll 53 of the next dryer group R to the drying wire 13 of this subsequent dryer group R so as to run in the main running direction K to the impingement drying units 30 in order to be dried. In connection with the transfer roll 53, for example, the profiling device 34 has been arranged, which profiling device can be, for example, an impingement drying unit.

The next group R is inverted with respect to the preceding group, in which connection the other side of the web W is dried by means of it. The dryer group R includes impingement drying units 30, support rolls 32 placed between them, and a transfer roll 53 and a wire guide roll 41 placed at the end of the arm 61,62 of the frame structure 60, and a guide-tension device 65, respectively. The roll 41 is a wire guide roll 41 and the roll 53 is a transfer roll 53, for example, a transfer suction roll provided with one or more suction zones. This group R is additionally provided with one external wire guide roll 42 with a doctor 43 arranged in connection with it. The next group R is a group corresponding to the first group R and, similarly, the last group R shown in the figure corresponds to the second group R, i.e. each side of the web W is alternately dried. From the last group R the web W is passed over a transfer roll 51 onto a wire 14 for further processing or to the subsequent dryer groups, which may be dryer groups in accordance with the invention or based on multi-cylinder drying.

As shown in the figure, the dryer groups R have been placed in an overlapping relationship with respect to one another, whereby the length of the dryer section is considerably shortened. Between the first and the second group R and, similarly, between the second and the fourth group R, the run of the web W is turned so as to be in a direction substantially opposite to the main running direction K, while between the second and the third group R the web W is passed substantially in the same running direction K from one group to the next.

As shown in FIG. 2, each dryer group has been formed so that its main direction is inclined, and rolls (transfer roll 31, 53, turning roll 52, wire guide roll 41) have been attached to the free ends of the support arms of the frame structure 60, and under-pressure devices 33, 330 and support rolls 32 have also been supported on the frame structure.

Figure 3:
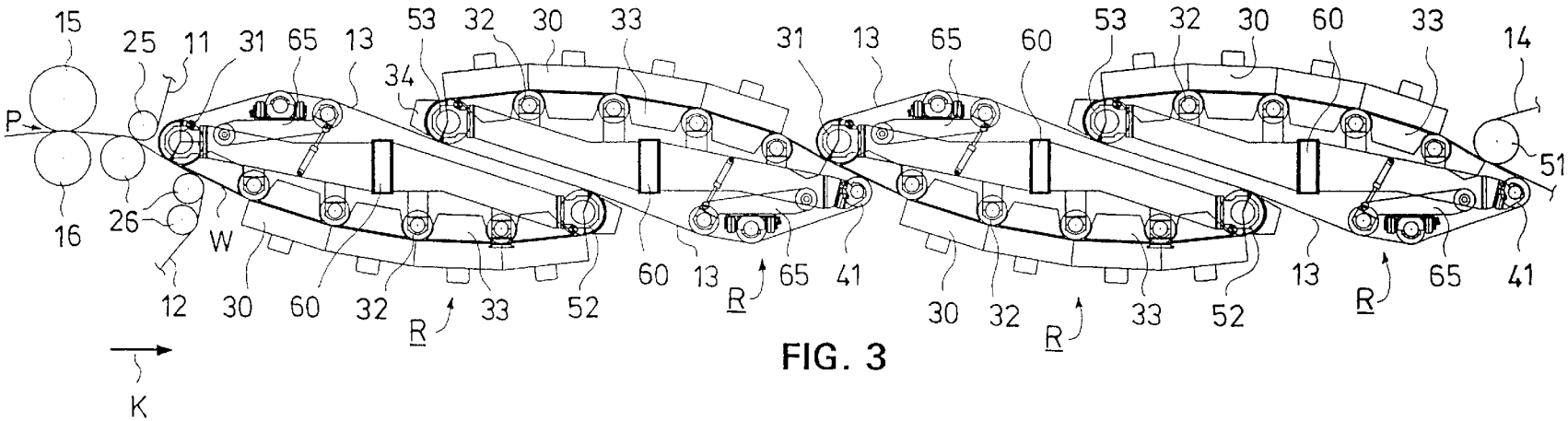
FIG. 3 schematically shows another application of a portion of a dryer section formed of dryer groups according to the invention, in which portion no outside rolls are used in the dryer groups.

The embodiment example of the invention shown in FIG. 3 mainly corresponds to the one shown in FIG. 2 and corresponding parts have been denoted by the same reference numerals. In this embodiment of the invention shown in FIG. 3, no external wire guide rolls are used, but, instead, guiding and leading of the wire 13 is performed completely by means of rolls 31, 53, 32, 41, 52 and a guide-tension device 65 placed inside the wire loop 13.

Figure 4:
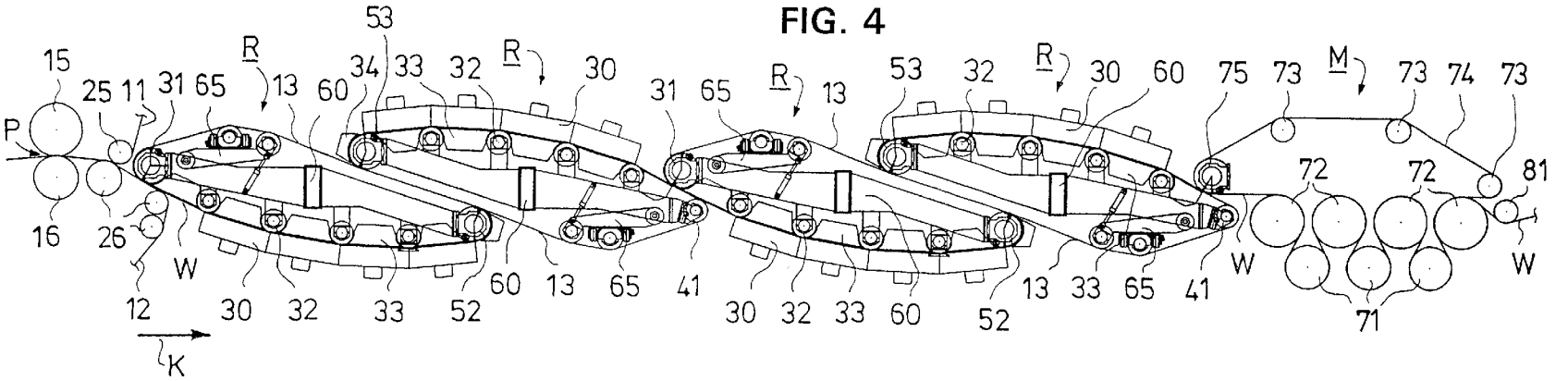
FIG. 4 schematically shows an application of the invention in which dryer groups according to the invention are followed by a multi-cylinder dryer group.

As shown in FIG. 4, dryer groups R according to the invention can also be combined with traditional multi-cylinder drying and, here, a normal dryer group M provided with single-wire draw has been placed after dryer groups R according to the invention, in which dryer group M there are lower reversing rolls or cylinders 71, advantageously reversing rolls marketed by Metso Paper, Inc. under the trademark VacRoll™, and upper drying cylinders 72. Guide rolls have been denoted by the reference numeral 73 and the drying wire by the reference numeral 74. From the last dryer group R according to the invention, the web W is passed by means of a transfer roll 75, for example, a transfer suction roll comprising one or more suction zones, to the single-wire draw, in which the web W runs along a meandering path from the drying cylinders 72 to the reversing rolls 71 and, on the drying cylinders 72, the web W is between the drying wire 74 and the heated drying cylinder surface. The web W is passed from the dryer group M applying single-wire draw over a roll 81 to further processing or to the subsequent dryer groups. In FIG. 4, the side of the web W dried by means of the last dryer group is opposite to that dried by the preceding group R according to the invention.

Figure 5:
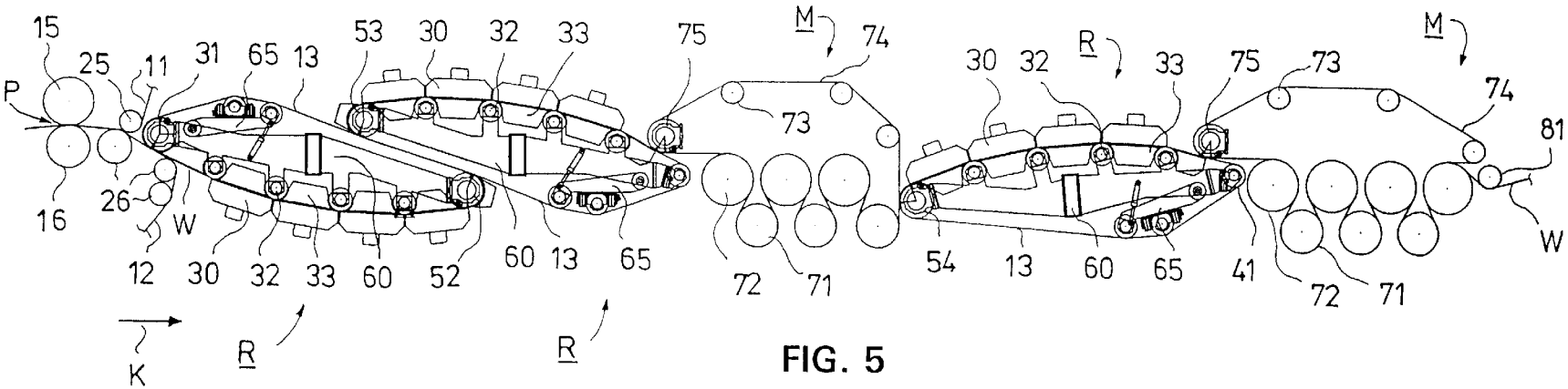
FIG. 5 schematically shows an application of the invention in which a dryer group according to the invention is used between multi-cylinder dryer groups.

In the application of the invention shown in FIG. 5, a normal dryer group M that applies single-wire draw has been placed between the second and the third dryer group R according to the invention, in which dryer group M a drying wire 74 runs from reversing rolls 71 to drying cylinders 72 and is guided by a transfer roll 75 and guide rolls 73. Here, the single-wire draw group M placed between the dryer groups R in accordance with the invention dries the side which is opposite to that dried by the preceding and the next dryer group R according to the invention. In the embodiment example of the invention shown in FIG. 5, the dryer group R according to the invention placed between dryer groups M applying single-wire draw has been placed substantially obliquely downwards with respect to the horizontal direction. The web W is passed from the preceding dryer group M applying single-wire draw to the dryer group R according to the invention over a transfer roll 54.

The arrangement shown in FIGS. 4 and 5, in which a group applying normal single-wire draw M has been placed at the end of a dryer section, is particularly advantageous in that the web W can be run in a controlled manner into a pulper.

Figure 6:
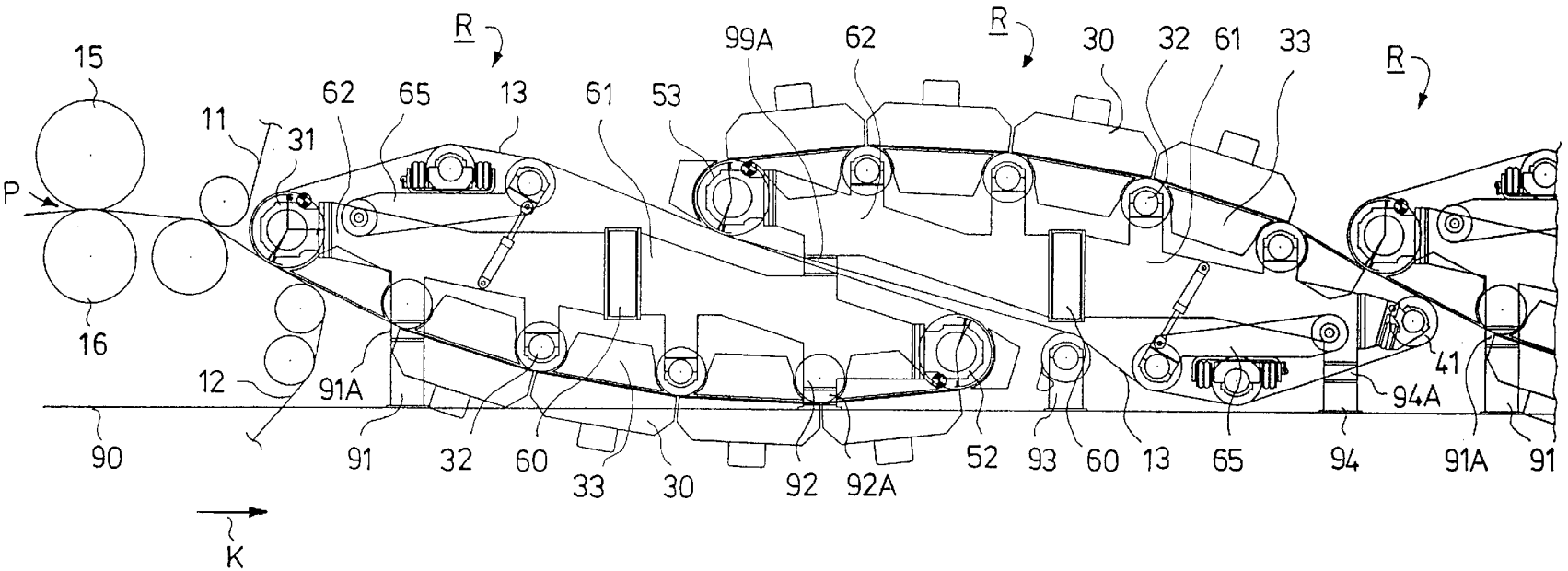
FIG. 6 schematically shows one application for a set of cantilever frames of a dryer group according to the invention.

As shown in FIG. 6, the frame structure 60 placed within the wire loop 13 of the dryer group R according to the invention is cantilevered. The cantilevered frame structure 60 is supported on a tending platform 90 so as to rest on support beams; the first group on support of support beams 91,92 and the second group on support of support beams 92, 94 and the frame structure 60 of the first group. The support beams 91, 92, 94 and the frame structures 60 have been provided with detachable spacer blocks 91A, 92A, 94A, 99A, which are removed for the time of cantilevering, in which connection the wire loop 13 can be threaded in place around the frame structure 60 as a ready-made loop, i.e. as a factory-seamed wire. Cantilevering is in itself known to a person skilled in the art in connection with installation of press section fabrics, and therefore it is not explained in more detail in this connection. It shall thus be noted that the novel type of frame structure 60 of the dryer group R according to the invention enables cantilevering for installing the wire loop 13 in place in connection with the dryer group, thereby providing the above-noted advantages which the compact dryer group of the invention with its frame structure enables to be achieved.

Above, the invention has been described with reference to only some of its advantageous details, to which the invention is, however, not intended by any means to be narrowly confined. For example, dryer groups according to the invention may also be imagined being applied such that FIG. 2 or 3 are looked at with the figure turned upside done, in which connection the main running direction K is from the right to the left and in which connection the first dryer group R of the invention after the press thus dries the top surface of the web.

It is understood that the invention is not limited to the particular construction and arrangement of parts herein illustrated and described, but embraces all such modified forms thereof as come within the scope of the following claims.

I claim:

1. A dryer soup in a dryer section of a paper or board machine comprising at least one impingement drying unit for drying a paper or board web and a drying wire formed into a loop on support of which web is arranged to pass by the at least one impingement drying unit, wherein the improvement comprises;

the at least one impingement drying unit being placed outside the loop formed by the drying wire, and a frame structure within the wire loop;

a plurality of rolls and devices which are placed inside the wire loop and which guide and support a run of the wire and the web, wherein all the rolls and devices which are place inside the wire loop and which support the wire loop are supported on the frame structure placed inside the wire loop.

2. The dryer group of claim 1 further comprising:

a first roll mounted to the frame to rotate about a first axis; and a second roll mounted to the frame to rotate about a second axis, the second roll being positioned downstream of the first roll, wherein the drying wire extends between the first roll and the second roll, the first roll being the most upstream roll within the drying wire, and the second roll being the most downstream roll within the drying wire, and wherein a reference plane is defined which extends through the first axis and the second axis, and wherein an angle is defined between a horizontal plane and the reference plane which is at an angle between 2–30°.

3. The dryer group of claim 1 further comprising a plurality of under-pressure devices positioned inside the drying wire loop on a side substantially opposite to the at least one impingement drying unit to support and guide the drying wire and the web.

4. The dryer group of claim 3 further comprising support rolls mounted to the frame in connection with the under-pressure devices.

5. The dryer group of claim 1 wherein the frame structure is a cantilevered frame structure supported by a plurality of beams extending from a tending platform, the beams having detachable spacer blocks which can be removed to cantilever the frame structure for a time during which the drying wire can be threaded in place as a loop.

6. The dryer group of claim 1 wherein the frame structure has two arms attached to each other and extending in opposite directions, and each arm has a free end, a roll being placed at the free end of each arm to support a run of the web and the wire.

7. The dryer group of claim 1 further comprising a combined guide and tension device attached to the frame structure inside the drying wire loop, which device comprises a guide roll for guiding the run of the drying wire and a tension roll displaceable by an actuator for regulating the tension of the drying wire.

8. A dryer section of a paper or board machine comprising at least one dryer group having at least one impingement drying unit for drying a paper or board web and a drying wire formed into a loop on support of which the web is arranged to pass by the at least one impingement drying unit along a run, the at least one impingement drying unit being placed outside the loop formed by the, drying wire, and a frame structure positioned inside the loop which supports devices and rolls situated inside the wire loop of the dryer group, the devices and rolls guiding and supporting the run of the wire and the web, wherein all the devices and rolls which are placed inside the wire loop and which guide and support the drying wire are supported on the frame structure positioned inside the wire loop.

9. The dryer section of claim 8 wherein several dryer groups based on impingement drying have been placed one after the other such that opposite sides of the web are dried with the successive dryer groups.

10. The dryer section of claim 8 where a closed draw is formed between gaps between said several dryer groups.

11. The dryer section of claim 8 wherein the plurality of dryer groups are positioned in an overlapping fashion with respect to one another.

12. The dryer section of claim 8 further comprising at least one dryer group applying single-wire draw.

13. A dryer section comprising:

a first dryer group having a first frame supporting an upstream roll and a downstream roll, and a first drying wire which is looped around the upstream roll and the downstream roll to define a first drying wire loop which has an outwardly facing surface which supports a web thereon along a first run which extends between the upstream roll and the downstream roll on a downwardly facing portion of the first drying wire loop, and at least one impingement drying unit is mounted outside the first loop to direct air onto the first run of the web; and a second dryer group having a second frame supporting a second upstream roll and a second downstream roll, and a second drying wire which is looped around the second upstream roll and the second downstream roll to define a second drying wire loop which has an outwardly facing surface which supports the web thereon along portions of a third run which extends between the second upstream roll and the second downstream roll, wherein the second dryer group second upstream roll is positioned upstream of the first dryer group downstream roll, and wherein the web extends along a second run between the first dryer group first downstream roll and the second dryer group second upstream roll, the second dryer group thereby overlapping the first dryer group to define a closed draw therebetween over which the web travels.

14. The dryer section of claim 13 wherein the first upstream roll rotates about a first axis, and wherein the first downstream roll rotates about a second axis, and wherein a reference plane is defined which extends through the first axis and the second axis, and wherein an angle is defined between a horizontal plane and the reference plane which is between 2–30°.

15. The dryer section of claim 13 further comprising a plurality of under-pressure devices positioned inside the first drying wire loop on a side substantially opposite to the first group at least one impingement drying unit to support and guide the first drying wire and the web.

16. The dryer section of claim 13 wherein the first frame and the second frame are each cantilevered frame structures supported by a plurality of beams extending from a tending platform, the beams having detachable spacer blocks which can be removed to cantilever the frame structures for a time during which the respective drying wires can be threaded in place as a loop.

17. The dryer section of claim 13 further comprising a combined guide and tension device attached to the first frame inside the first drying wire loop, which device comprises a guide roll for guiding the run of the drying wire and a tension roll displaceable by an actuator for regulating the tension of the first drying wire.

18. The dryer section of claim 13 wherein the first drying wire is supported on the first frame by a plurality of devices and rolls placed inside the first drying wire is loop which guide and support the first wire, wherein all said plurality of devices and rolls which are placed inside the first wire loop and which support the first drying wire are attached to the frame structure inside the first drying wire loop.

19. A dryer group in a dryer section of a papermaking machine comprising:

a frame;

a first roll mounted to the frame to rotate about a first axis;

a second roll mounted to the frame to rotate about a second axis, the second roll being positioned downstream of the first roll;

a drying wire formed into a loop which encircles the first roll and the second roll, wherein the drying wire extends between the first roll and the second roll, the first roll being the most upstream roll within the drying wire, and the second roll being the most downstream roll within the drying wire, and wherein a reference plane is defined which extends through the first axis and the second axis, and wherein an angle is defined between a horizontal plane and the reference plane which is at an angle between 2–30°; and at least one impingement drying unit being placed outside the loop formed by the drying wire, wherein a web run is defined on the drying wire loop extending between the first roll and the second roll to support a web thereon to pass by the impingement drying unit.

* * * * *

UNITED STATES PATENT AND TRADEMARK OFFICE

CERTIFICATE OF CORRECTION

PATENT NO. : 6,510,623 B2
DATED : January 28, 2003
INVENTOR(S) : Juhani Pajula

It is certified that error appears in the above-identified patent and that said Letters Patent is hereby corrected as shown below:

Column 8,
Line 48, “soup” should be -- group --
Line 60, “place” should be -- placed --

Column 9,
Line 41, “the,” should be -- the --

Signed and Sealed this

Twenty-fifth Day of March, 2003

JAMES E. ROGAN
*Director of the United States Patent and Trademark Office*